US005937485A

United States Patent [19]

Dittmer

[11] Patent Number: 5,937,485

[45] Date of Patent: Aug. 17, 1999

[54] DEVICE FOR FASTENING PAPER

[76] Inventor: Allen J. Dittmer, 4802 Stillwell Rd., Wilmington, N.C. 28412

[21] Appl. No.: 08/975,155

[22] Filed: Nov. 20, 1997

Related U.S. Application Data

[60] Provisional application No. 60/032,099, Dec. 4, 1996.

[51] Int. Cl.[6] ..... B42F 1/02; B42F 1/12

[52] U.S. Cl. ..... 24/67 R; 24/67.5; 24/536; 24/539

[58] Field of Search ..... 24/67 R, 67.3, 24/67.5, 67.9, 67 CF, 538, 539, 541, 536, 537, 67.1, 67.11; 281/45

[56] References Cited

U.S. PATENT DOCUMENTS

| | | | |
|---|---|---|---|
| 1,475,542 | 11/1923 | Conneighton | 24/67.5 |
| 1,783,678 | 12/1930 | Shaw | 24/539 |
| 2,086,234 | 7/1937 | Neidhart | 24/541 X |
| 3,973,705 | 8/1976 | Erthein | 24/538 X |

FOREIGN PATENT DOCUMENTS

| | | | |
|---|---|---|---|
| 374312 | 6/1932 | United Kingdom | 24/539 |

*Primary Examiner*—James R. Brittain
*Attorney, Agent, or Firm*—Mills Law Firm PLLC

[57] ABSTRACT

A paper fastening device for securing a stack of papers in superposed relation without creasing or deformation of the papers is disclosed. The paper fastening device includes a flexible body portion comprising a pair of generally flat, members which are interconnected by flexible hinges such that stacks of paper of variable thicknesses can be inserted therebetween. A clamping member is integrally formed with the body portion and adapted for pivoting movement so as to compress the body portion against the stack of papers and retain them in the clamping member under spring tension. In one embodiment, the device is fabricated entirely from a sheet of flexible plastic material and folded into its function configuration. In this version a conventional steel binder clip is disposed within the clamping member to provide the spring tension for the clamping member. In an alternative embodiment the entire device is molded from a thermoplastic material in its completed configuration. The fastening device is provided in different configurations for attachment to the corner of the paper stack or, in the alternative, to a lateral edge of the paper stack.

15 Claims, 9 Drawing Sheets

DEVICE FOR FASTENING PAPER

CROSS REFERENCE TO RELATED APPLICATION

This Application claims the benefit under 35 U.S.C. 119(e) of U.S. Provisional Application No. 60/032,099 filed Dec. 4, 1996 by Allen J. Dittmer for Device for Fastening Paper.

BACKGROUND OF INVENTION

Field of Invention

The present invention relates generally to fastening devices and, more particularly, to a device for securing a number of sheets of paper together in a neat and orderly fashion.

It is well known in the art to fasten several sheets of paper together in a stack to form a document which can range from a couple of pages to many hundreds.

Numerous types of paper fastening devices have been disclosed in the prior art. For example, the common paperclip available in different sizes can be utilized to secure several sheets of paper together. However, the individual paper sheets are easily displaced during handling which disrupts the neatness of the document.

Many files and documents have more numerous pages. For example, 10 to 50 sheets of paper or more can be fastened together in a removable manner by the use of high tension binder clips and spring clips such as ACCO Binder Clips. However, such devices have several disadvantages. Most of the binder clips require lever handles to obtain enough leverage to open the high tension jaws of the clamp mechanism. Such lever handles can be difficult to use and cause the secured document to have a bulky profile.

Further, in order to accommodate a variable number of sheets, the jaws of most binder clips grab a thin stack at a sharply oblique angle thereby presenting a very narrow binding surface to the paper. Because the effective binding surface of these devices is quite narrow, they leave a deformation on the surface of the paper. Thus, the sheets near the top and bottom of the stack frequently tear at the site of binding when the document is placed between other documents in the file because these sheets tend to slide laterally from the stack and against the narrow binding surface of the clip.

So-called corner fasteners are also known in the prior art. For example, U.S. Pat. No. 5,212,850 discloses a device for holding several sheets of paper together at the corner of the stack. However, the number of sheets that can be successfully bound by full contact with the binding faces thereof is limited by the width of the hinge and the clasp. When such a device is applied to a stack that is thinner than the width of the hinge, the papers in the stack tend to slip and the top and bottom sheets are creased and subject to tearing. In addition the opening and closing of the fastener requires the manipulation of two separate clasps to secure or release the paper stack.

In view of the problems described above, there is need for a paper fastener capable of accommodating paper stacks of various thicknesses that is simple to operate and conforms to the shape of the paper stack to provide a low profile for storage. Further, it is desirable to provide a paper fastener wherein the stack of papers to be secured is utilized to pry open the clamping mechanism thereby eliminating the levering arms which form a part of conventional binder clips.

DESCRIPTION OF RELATED PRIOR ART

U.S. Pat. No. 1,146,591 to Otto W. Niedomanski discloses a corner paper fastening device consisting of a generally triangular body to receive the corners of superimposed sheets of paper which is adapted to be bent over the same causing deformation of the corners of the paper sheets.

U.S. Pat. No. 2,843,901 to Edward Z. Bukowski discloses a corner paper clip formed of a malleable metal which is adapted to be bent over the corner of a stack of papers also causing deformation of the papers to be secured.

U.K. Patent No. 558,609 discloses an improved means for fastening paper sheets together that discloses a fastening device of paper or fabric material which is folded over the corner of a stack of papers to adhesively secure the pages together. However, this invention requires a plurality of separate devices for fastening multiple sheets of paper and is limited in the number of sheets of paper which can be fastened.

U.S. Pat. No. 2,853,043 to Marie L. Bitterman et al. discloses a page corner mark for books of paper construction which is folded in triangular sections and guided into superimposed relation with a selected page of a book. However, this device will not function to secure a stack of papers together in the manner of the present invention.

U.S. Pat. No. 5,404,622 to Hisao Sato discloses corner clips and corner clipping apparatus for clipping a plurality of sheets of documents at their corner part without piercing the documents. The corner clip is applied to a paper stack by the use of a clipping apparatus which is a manually operated tool for installing the clips.

U.S. Pat. No. 5,272,792 to Matthew C. Harper discloses a corner type paper clip which is used to secure a plurality of sheets of paper together. The paperclip comprises a bendable metallic body which is bent to retain the paper stack causing deformation of the corners of the paper.

U.S. Pat. No. 5,212,850 to Natalie Rerolle discloses a device for holding several leaves of paper together at the corner of a stack. Although this device avoids substantial deformation of the stack of papers to be held, it's capacity is limited to a stack having a thickness bearing between two and about 10 or 20 leaves to be effectively held.

Finally, French Patent No. 2,423,344 to Metni discloses a clip utilized for paper items.

SUMMARY OF THE INVENTION

After much research and study into the above problems, the present invention has been developed to provide a paper fastening device capable of securing documents of variable thicknesses in superposed relation without deformation or creasing of the document papers. The present invention provides a high pressure clamping mechanism which is simple to operate and provides numerous functional features not available in the prior art.

This is accomplished with the present invention by providing a paper fastening device constructed of a single piece of resilient material which is folded to form a body portion having a pair of generally parallel, opposed flat members which are joined by a flexible hinge. A rotatable clamping portion including a binder clip is integrally formed with the body portion in proximity thereto and functions to press the opposed flat members together securing the paper stack therebetween.

In one embodiment the paper fastening device is constructed so as to be disposed on the corner of a stack of papers to secure a document. In an alternative embodiment the paper fastening device is configured to be disposed along a lateral edge of a stack of papers to secure the same in a neat and orderly fashion.

In view of the above, it is an object of the present invention to provide a paper fastening device that is capable of securing documents of variable thicknesses without deformation or creasing of the document papers.

Another object of the present invention is to provide a paper fastening device that is simple to manually install and remove even with one hand of a user.

Another object of the present invention is to provide a paper fastening device having a slim profile conforming to the shape of the stack of papers.

Another object of the present invention is to provide a paper fastening device that can be color coded for identification.

Another object of the present invention is to provide a paper fastening device having an outer surface that can accommodate an identification label for the document to be secured.

Another object of the present invention is to provide a paper fastening device which is constructed essentially of a single piece of resilient plastic material.

Another object of the present invention is to provide a paper fastening device which eliminates the leverage arm component of conventional binder clips.

Another object of the present invention is to provide a paper fastening device wherein the stack of papers secured within the device provides sufficient leverage to actuate the clamping mechanism thereof.

Other objects and advantages of the present invention will become apparent and obvious from a study of the following description and the accompanying drawings which are merely illustrative of such invention.

DETAILED DESCRIPTION OF PREFERRED EMBODIMENT

Figure 1:
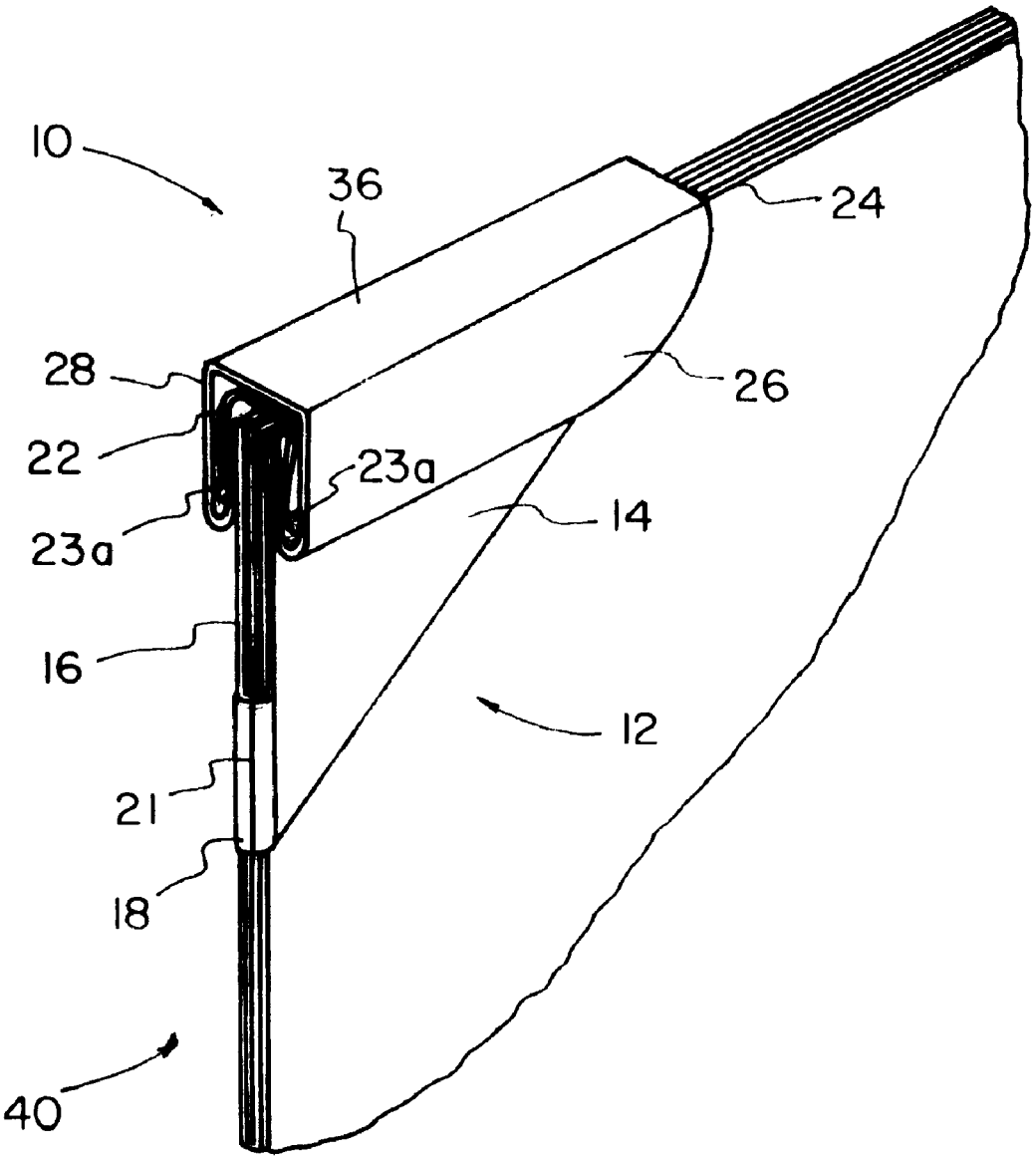
FIG. 1 is a perspective view of one embodiment of the paper fastening device of the present invention shown in a position of engagement on the corner of a stack of papers.

With further reference to the drawings there is shown therein a paper fastening device in accordance with the present invention, indicated generally at 10 and illustrated in FIG. 1. The fastening device 10 is shown in a position of engagement being installed on the corner of a stack of papers, indicated generally at 40.

In the preferred embodiment the fastening device 10 includes a body portion, indicated generally at 12 wherein the corner of a paper stack 40 is initially inserted and a clamping member, indicated generally at 20, being integrally formed in pivoting relation thereto.

Figure 2:
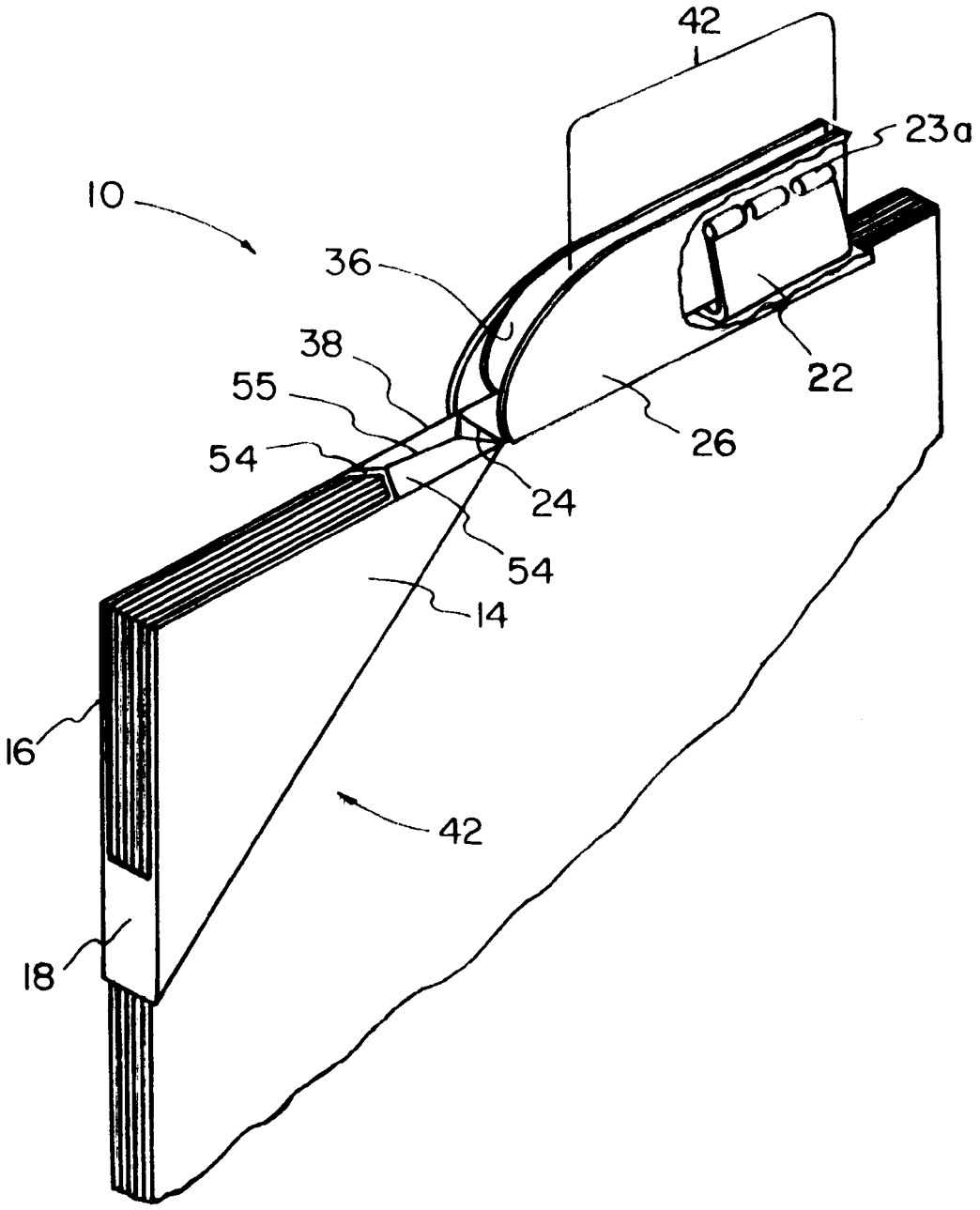
FIG. 2 is a perspective view of the paper fastening device of FIG. 1 with a partial cutaway section and shown in a position of disengagement.

The clamping member 20 encloses a conventional U-shaped binder clip 22 as shown in the partial cutaway view in FIG. 2. Thus, in general operation the clamping member 20 is pivoted about hinge 38 downwardly onto the body portion 12 at an angle thereby spreading open the binder clip 22 and compressing the body portion 12 containing the paper stack 40 therein to the position shown in FIG. 1 with minimal effort by a user.

Figure 3:
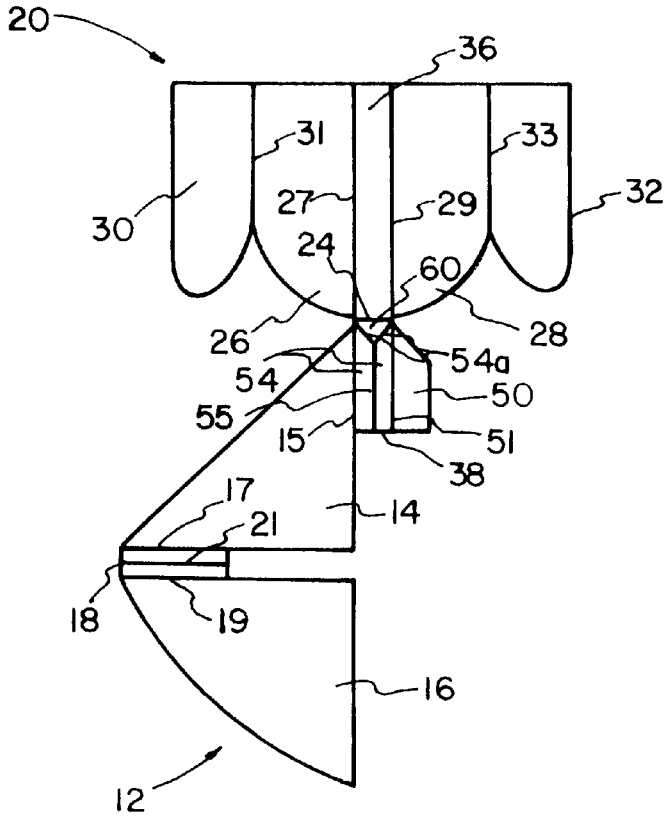
FIG. 3 is a plan view of a pattern layout for the paper fastening device showing the details thereof.

Turning now to FIG. 3, the construction of the paper fastening device 10 will be described in detail. It will be appreciated by those skilled in the art that in the preferred embodiment the fastening device 10 is fabricated from a single sheet of a flexible plastic material such as polypropylene or other suitable material having a predetermined thickness and hardness in order to simplify the manufacturing process.

FIG. 3 illustrates a pattern layout for a blank of material for the construction of the fastening device 10, which is cut out or stamped using known manufacturing techniques. The blank includes at one end thereof the body portion 12 comprised of a generally semi-circular lower body member 16, a triangular upper body member 14, and a flexible hinge 18 extending therebetween.

An inner longitudinal edge portion of lower body member 16 is integrally connected to an adjacent longitudinal edge of hinge 18 along a score line 19 where the blank is folded and pivotally connects the lower body member 16 to the hinge 18.

Figure 4A:
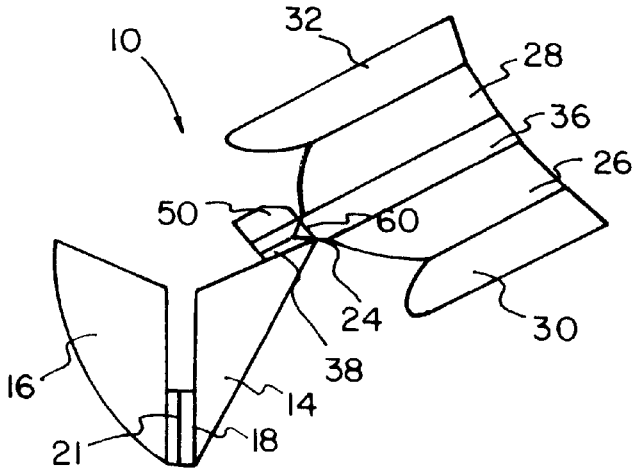
FIGS. 4A through 4F are a series of perspective views showing the folding sequence used in the construction of the paper fastening device.

The opposing longitudinal edge portion of hinge 18 is integrally connected to an adjacent edge of upper body member 14 along score line 17 where the blank is folded to the position shown in FIG. 4*a*.

Hinge 18 may be provided with an optional score line 21 along a longitudinal centerline thereof to impart added flexibility to the hinge 18.

An adjacent edge of the upper body member 14 is integrally connected to an adjacent longitudinal edge portion of a concertina hinge 38 along score line 15 resembling the bellows of a concertina in form and function.

The concertina hinge 38 includes a pair of generally parallel wing-shaped members 54 which are symmetrically disposed on either side of a score line 55 about which the wing members 54 are folded to form an upwardly projecting wedge shape similar to a concertina or accordion bellows As shown in FIG. 3 the symmetrical wing tip portions 54*a* are integrally connected to the adjoining edges of a triangular hinge plate 60 where the hinge 38 is also scored and folded.

It will be appreciated by those skilled in the art that in this configuration the concertina hinge 38 can be folded 180° onto itself along the score line 55 to accommodate stacks of paper of variable thicknesses. Further, the generally wedge-shaped configuration of hinge 38 as clearly shown in FIG. 2 functions to pry open the clamping member 20 in operation as described hereinafter in further detail.

The opposing longitudinal edge portion of the concertina hinge 28 is integrally connected to an adjacent longitudinal edge of connecting tab 50 along a score line 51 where the device is folded and pivotally connects the hinge 38 to the tab 50.

Figure 4B:
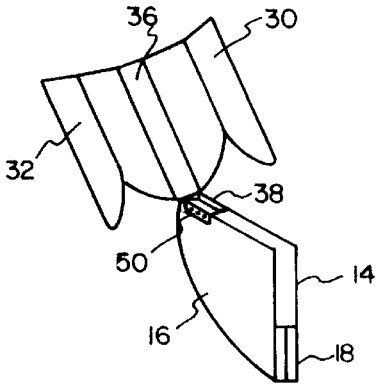

After folding the tab 50, a heat weld process or gluing process will be utilized to secure the body portion 12 to the tab 50 such that the upper and lower body members 14 and 16 are in generally parallel relation as shown in FIG. 4B.

A remaining lateral edge of the triangular hinge plate 60 is integrally connected to an adjacent end of a spine portion 36 of the clamping member 20 along score line 24 where the blank is folded and pivotally connects the hinge plate 60 to the spine portion 26 to provide pivoting movement between the clamping member 20 and the body portion 12.

A first longitudinal edge portion of spine 36 is integrally connected to an adjacent longitudinal edge of outer wall section 26 along score line 27 where the blank is folded and pivotally connects the outer wall section 26 to spine 36.

The opposing longitudinal edge portion of spine 36 is integrally connected to outer wall section 28 along a score line 29 where the blank is folded and pivotally connects the outer wall section 28 to the spine 36.

An opposite longitudinal edge of outer wall section 26 is integrally connected to an adjacent longitudinal edge portion of inner wall section 30 along a score line 31 where the blank is folded 180° such that the inner wall section 30 is disposed in overlying relation to the outer wall section 26.

Figure 4C:
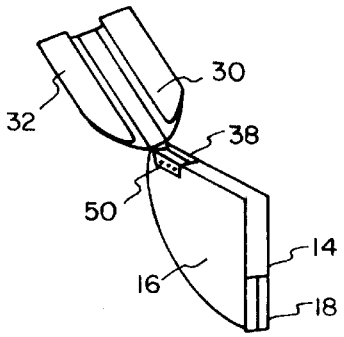

In a similar manner, the opposing longitudinal edge portion of outer wall section 28 is integrally connected to an adjacent longitudinal edge portion of inner wall section 32 along score line 33 where the blank is folded 180° such that the inner wall section 32 is disposed in overlying relation to the outer wall section 28 as shown in FIG. 4C.

Figure 4D:
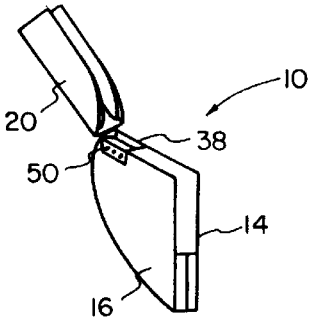

The opposing upper wall sections 26 and 28 are now folded 90° inwardly along score lines 27 and 29 so as to dispose the inner wall sections 30 and 32 in face-to-face relation as shown in FIG. 4D.

Figure 4E:
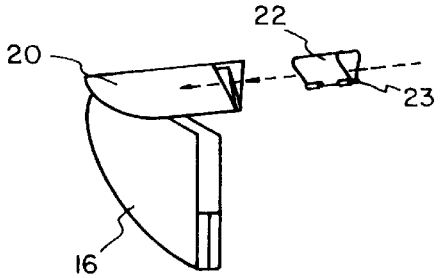
Figure 4F:
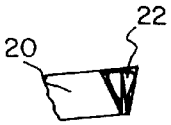

In this configuration the clamping member 20 is capable of receiving a binder clip 22 in the manner illustrated in FIGS. 4E and 4F.

Figure 5A:
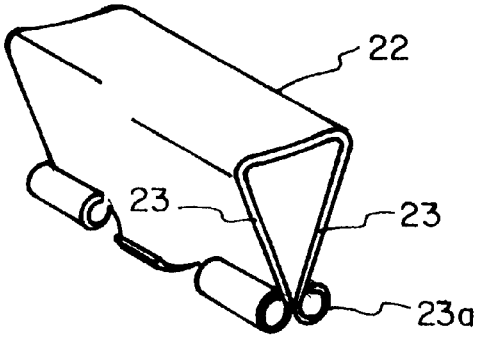
FIGS. 5A and 5B are perspective views depicting alternative embodiments of a binder clip utilized in the construction of the paper fastening device.

In the preferred embodiment the binder clip 22 is generally U-shaped in cross section being fabricated from a strip of spring steel or other suitable resilient material. The opposed jaw portions 23 thereof are biased inwardly into close proximity and include outwardly curved lip portions 23*a* as more clearly shown in FIG. 5A.

Figure 5B:
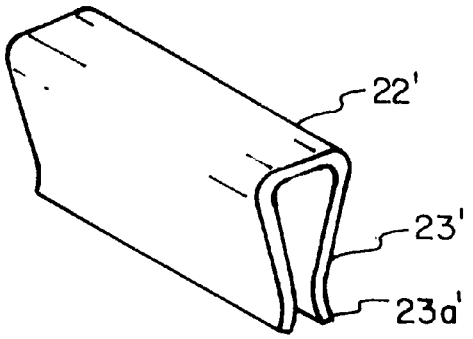

In an alternative embodiment the binder clip 22' is fabricated from a molded plastic material in the configuration shown in FIG. 5B.

The binder clip 22' includes opposed jaw portions 23' including outwardly turned lip portions 23*a'* to facilitate the insertion of a stack of papers 40 therein.

In either embodiment the binder clip functions to produce sufficient pressure to compress the body portion 12 containing a plurality of sheets of paper therein.

In order to assemble the clamping member 20 the binder clip 22 slidingly engages the inner wall sections 30 and 32 and is advanced into a clamping member 20 and permanently retained therein by spring tension in the position shown in FIG. 4F.

Figure 6:
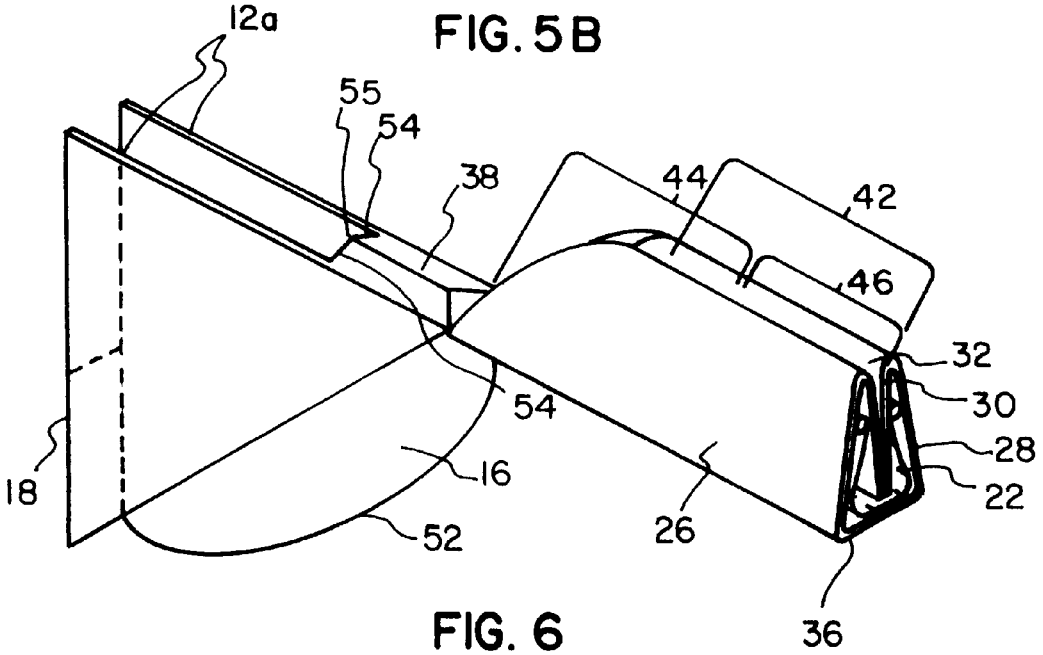
FIG. 6 is a perspective view of one embodiment of the paper fastening device in its completed condition.

Thus, when the assembly procedure as described hereinabove is completed, the paper fastening device 10 of the present invention will appear substantially as shown in FIG. 6. In this embodiment, it will be noted that the lower body member 16 includes a generally arcuate tab member 52 being integrally formed therewith. The tab member 52 extends downwardly beyond the opposed upper body member 14 to permit a stack of papers 40 to be easily inserted between the upper and lower body members 14 and 16 to be clamped together.

Figure 7:
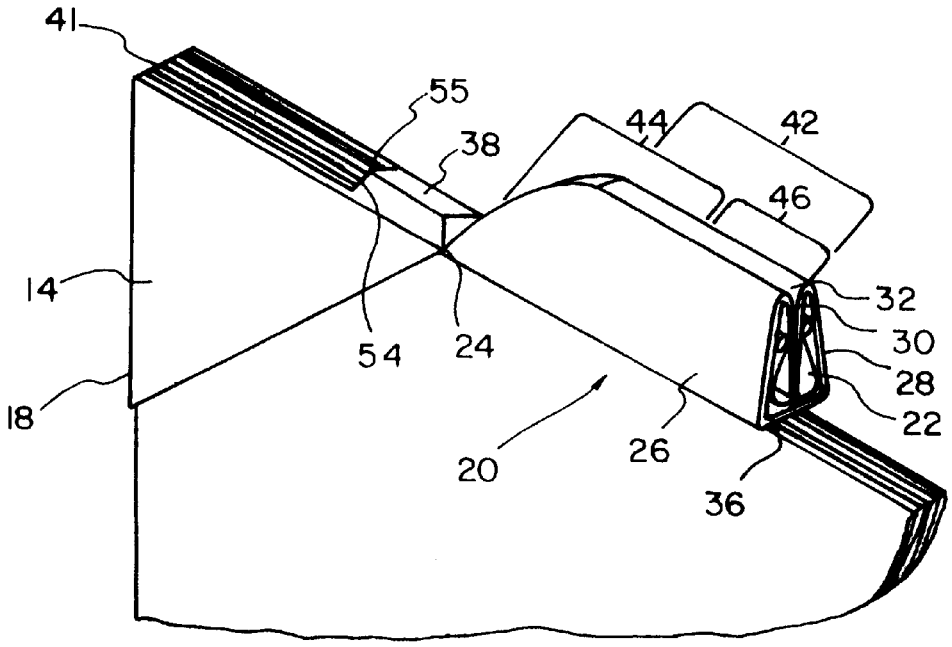
FIG. 7 is a perspective view of the paper fastening device shown in claim 6 being installed on the corner portion of a stack of paper.

Thus, in order to use the paper fastening device 10 of the present invention, a stack of paper 40 is placed between the upper and lower body members 14 and 16 so as to register with the corner 41 of the stack 40 and into direct contact with the hinges 18 and 38 as shown in FIG. 7. In this arrangement the hinges 18 and 38 function effectively to align the individual paper sheets neatly in superposed relation.

Thereafter, clamping member 20 is pivoted about the score line 24 to a position of engagement with the concertina hinge 38. It will be noted that the upwardly projecting, wedge-shaped configuration of the hinge 38 functions to spread apart the clamping member 20 adjacent the score line 24 permitting the inner wall sections 30 and 32 to slide downwardly over the outer surface of the upper and lower body members 14 and 16 and to slightly compress the paper stack 40 on either side of the hinge 38.

As the hinge 38 passes into the mouth 42 of the clamping member 20, the area of lowest spring tension as at 44 gradually separates to admit the upper edge of the body portion 12. As the pivoting movement of the clamping member 20 continues to the fully closed position of FIG. 1, the body portion 12 passes into the area of highest spring tension as at 46 forcibly separating the jaws 23 of the binder clip 22.

It will be appreciated that in the fully engaged position of FIG. 1 the upper edges of the body member 12 being fully inserted into the binder clip 22 are slightly decompressed permitting the upper edges of the body portion to expand slightly to resist any reverse pivoting movement that would disengage the clamping member 20.

Figure 8A:
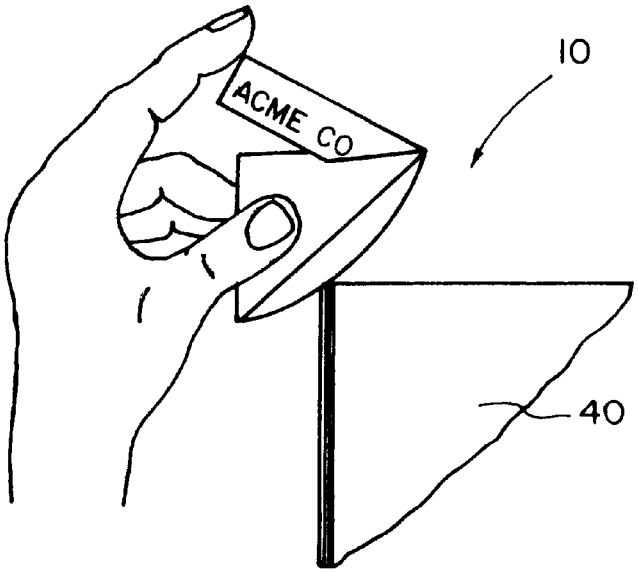
FIGS. 8A and 8B are perspective views showing a one-handed installation technique for the paper fastening device.
Figure 8B:
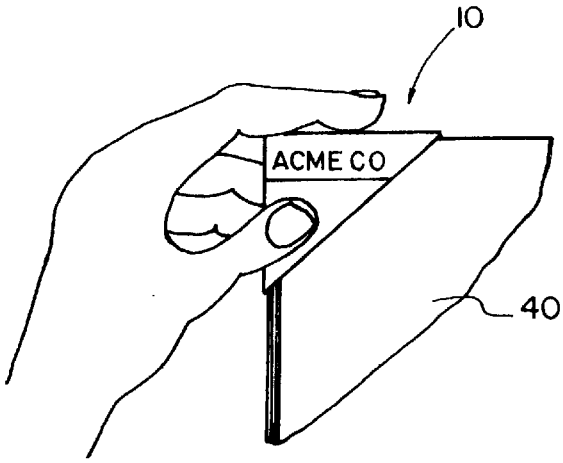
Figure 9A:
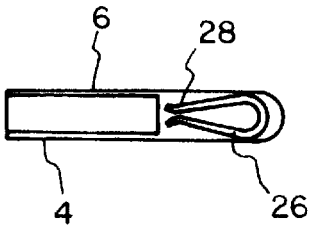
FIGS. 9A through 9D are a series of elevational views of an alternative embodiment of the paper fastening device.
Figure 9C:
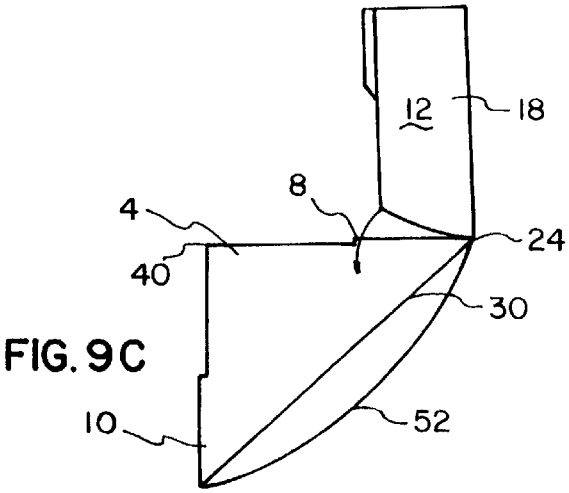
Figure 9B:
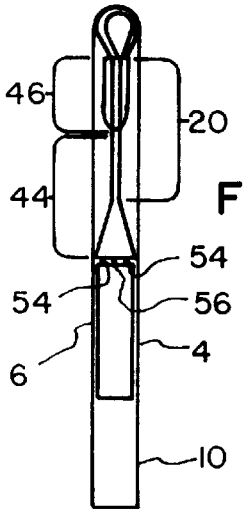
Figure 9D:
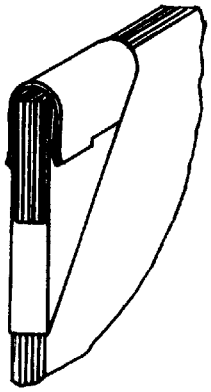

The wedge-shaped configuration of the concertina hinge 38 in combination with the compressed edge of the paper stack 40 provides mechanical leverage to the user of the device 10 such that little effort is required to operate the clamping member 20 in forcibly separating the jaws 23 of the binder clip 22. Thus, the fastening device 10 can be easily operated with one hand using only finger pressure as illustrated in FIGS. 8A and 8B.

Turning now to FIGS. 9A–9D there is shown therein an alternative embodiment of the present invention, indicated generally at 10'. In this version the fastening device 10' is molded in the configuration shown from thermoplastic materials by an injection molding process.

It can be seen that the body portion 12' and the clamping member 20' are generally similar in shape and function to that of the preferred embodiment described hereinabove. These components are molded to predetermined dimensions to permit maximum flexibility and compression of the body portion 12' by the clamping member 20' during use.

Figure 10A:
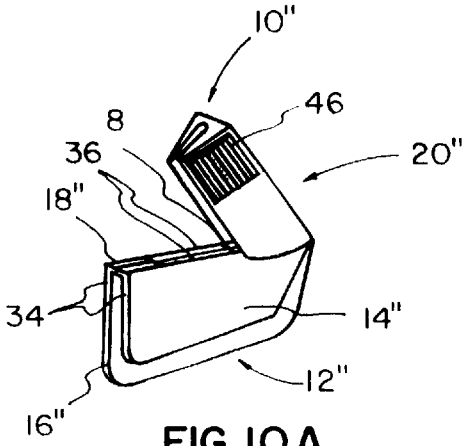
FIGS. 10A and 10B are perspective views of yet another alternative embodiment of the paper fastening device for installation on a lateral edge of a paper stack.

Turning now to FIG. 10A there is shown therein another alternative embodiment of the present invention for clamping a paper stack 40 along a lateral side thereof rather than at the corner.

It will be appreciated that this version of the fastening device 10" can be fabricated from either a flexible sheet plastic material or can be molded from a thermoplastic material by an injection molding process as described hereinabove.

In this embodiment the fastening device 10" includes a body portion 12" having an upper body member 14" and a lower body member 16" which differ in form from their respective counterparts as described hereinabove, but function in essentially the same manner.

In this version the upper and lower body members 14" and 16" are generally rectangular in shape in contrast to their triangular and semicircular counter parts in the preferred embodiment of the device 10.

In addition, the hinge 18" is repositioned to bridge the upper edges of the upper and lower body members 14" and 16" as shown in FIG. 10A.

Figure 10B:
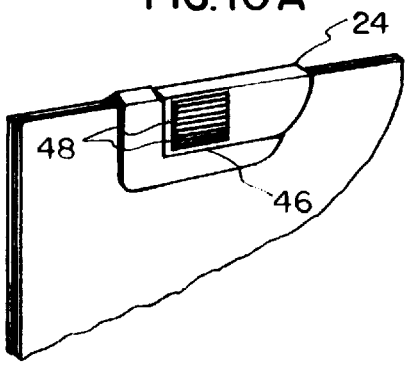

The clamping member 20" of the injection molded embodiment shown in the drawings FIG. 10A–10B is provided with a finger grip portion 46 including a plurality of parallel serrations or grooves 48 formed therein to provide a gripping surface for a user of the device.

Of course, such a finger grip portion may be applied to the other hereinabove described embodiments by heat welding or by application of a gripping surface using adhesives.

In all other respects it will be understood that the fastening device 10" functions in substantially the same manner as the previously described embodiments except that it is applied to the lateral side of the paper stack rather than to a corner thereof.

Figure 11:
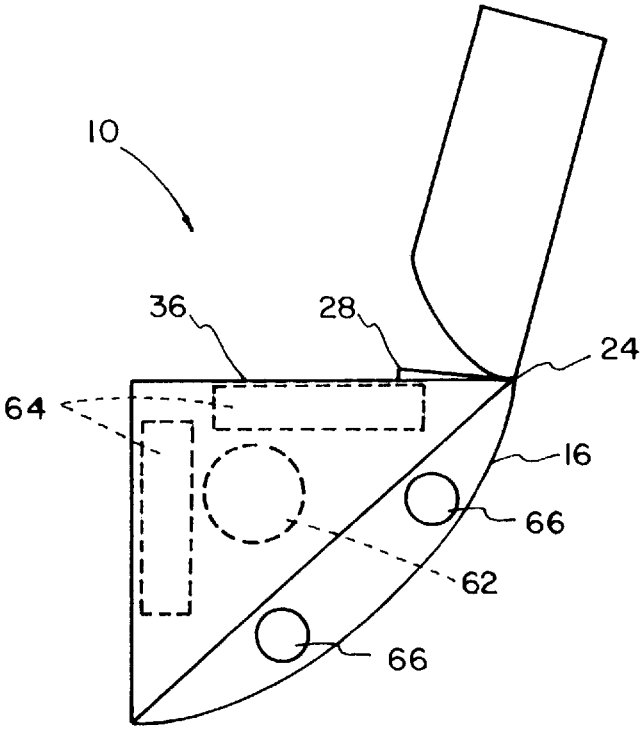
FIG. 11 is a side elevational view of one embodiment of the paper fastening device showing a composite view of attaching hardware for securing the device to a wall or other surface.

In yet another alternative embodiment shown in FIG. 11 the paper fastening device of the present invention is adaptable for attachment to another object such as a wall, bulletin board, window, a refrigerator, etc. where it may be useful to display documents and messages. In this embodiment the lower body member 16 is modified for use with various attaching hardware such as a magnet 62, VELCRO tape 64, thumb tacks 66 etc. as shown in composite view in FIG. 11.

Figure 12A:
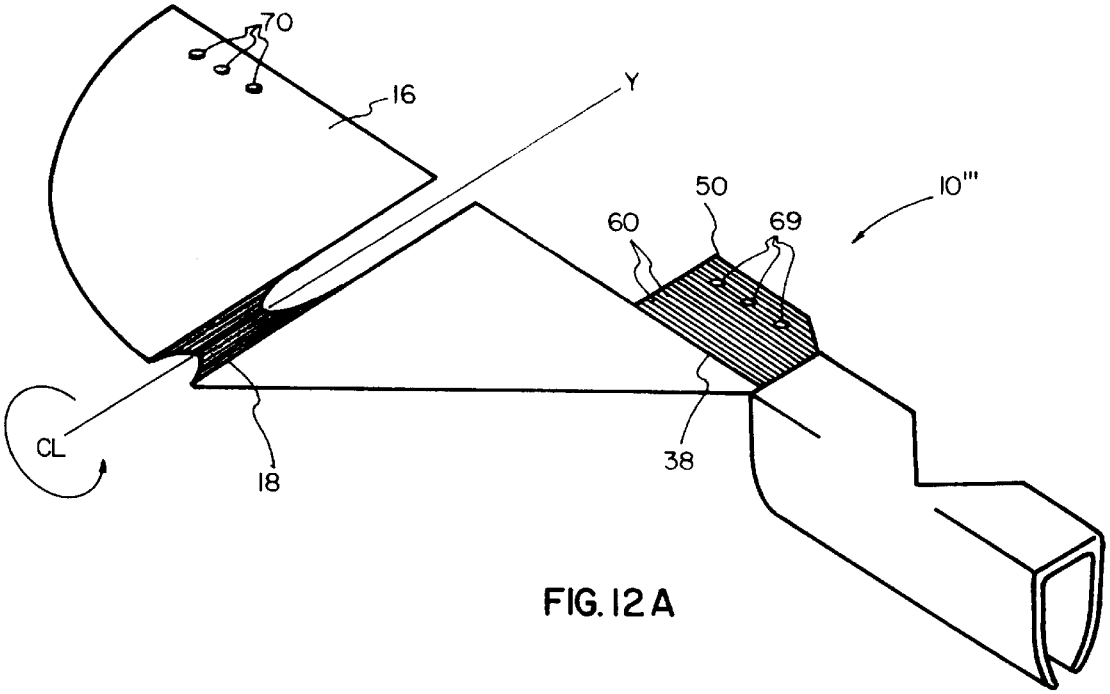
FIGS. 12A through 12C depict still another alternative embodiment of the paper fastening device in composite view.
Figure 12B:
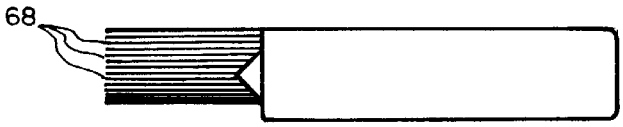

Referring now to FIG. 12A there is shown therein still another alternative embodiment of the paper fastening device of the present invention. In this embodiment the device 10'" is molded from a thermoplastic material in the configuration shown. The hinges 18 and 38 are modified to include a plurality of parallel grooves or striations 68 to provide maximum flexibility and to reduce bending fatigue of the material.

The connecting tab 50 is modified to provide a snap closure including a plurality of apertures 69 formed therein and adapted for mating engagement with a plurality of stud elements 70 integrally formed on the lower body member 16.

Figure 12C:
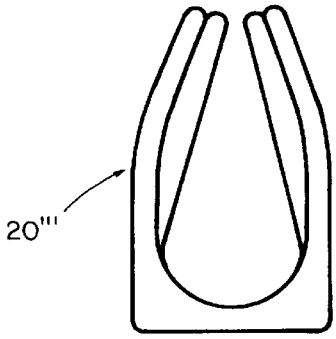

This embodiment features a clamping member 20'" of a molded construction having a so-called double claw design as shown in cross-section in FIG. 12C. In this construction the clamping member 20'" provides increased clamping tension with reduced bending fatigue in the molded plastic material due to repeated use of the device.

From the above it can be seen that the present invention provides a paper fastening device for repeated clamping and release of a stack of papers without folding or deformation of the paper documents.

The paper fastening device provides a high tension clamping mechanism which is easily operated by a user with finger pressure without the use of leverage arm components required in the prior art.

The paper fastening device is provided in different versions for clamping at the corner or along a lateral edge of a stack of paper to secure the same in a neat and orderly manner.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A paper fastening device for securing a stack of papers in superposed relation, said device comprising:

a flexible body portion including a pair of generally flat parallel members adapted to receive said stack of papers therebetween; and a clamping means including spring tensioning means being integrally connected to said body portion by flexible hinging means, said clamping means being imparted with reciprocal pivoting movement relative to said body portion from a paper engagement position wherein said papers are compressed in said body portion and retained to a paper disengagement position wherein said papers are removable from said body portion without deformation.

2. The paper fastening device of claim 1 wherein said spring tensioning means includes a binder clip installed internally of said clamping means functioning to compress said stack of papers in said paper engagement position.

3. The paper fastening device of claim 2 wherein said binder clip is fabricated from spring steel.

4. The paper fastening device of claim 2 wherein said binder clip is fabricated from a thermoplastic material.

5. The paper fastening device of claim 1 wherein said flexible hinging means is constructed so as to be expandable to accommodate stacks of paper of variable thicknesses.

6. The paper fastening device of claim 5 wherein said hinging means is constructed in the shape of a concertina bellows having a generally wedge-shaped cross section, said flexible hinging means functioning to forcibly separate said clamping means as it is pivoted into said paper engagement position.

7. The paper fastening device of claim 1 wherein said body portion is configured to be installed on a corner portion of said stack of papers.

8. The paper fastening device of claim 7 wherein said body portion is configured to align said stack of papers in said superposed relation by contacting two adjacent side edges thereof at said corner portion.

9. The paper fastening device of claim 1 wherein said body portion is configured to be installed on said stack of papers along any lateral edge thereof.

10. The paper clamping device of claim 1 wherein said body portion and said clamping means are symmetrically disposed about a common plane, said clamping means pivoting in said plane during rotation from said paper engagement position to said paper engagement position.

11. The paper fastening device of claim 1 wherein said device is fabricated from a flexible sheet of plastic material being folded into its functional configuration.

12. The paper fastening device of claim 1 wherein said device is molded from a thermoplastic material in its functional configuration.

13. A method of fastening a stack of papers in superposed relation without deformation thereof, said method comprising the steps of:

providing a paper fastening device including a flexible body portion having a pair of flat members adapted to receive said papers therebetween and a clamping means being integrally connected to said body portion by flexible hinging means;

inserting said stack of papers between said flat members;

pivoting said clamping means about said hinging means from a paper disengagement position to a paper engagement position;

prying apart said clamping means by slidingly engaging said hinging means therein; and compressing said stack of papers within said clamping means such that said stack of papers is retained therein without deformation.

14. The method of claim 13 wherein the step of providing further includes the steps of:

cutting a blank for said device from a sheet of flexible plastic material;

scoring a plurality of lines on said blank to define structural elements of said device;

folding said blank along said score lines to its completed configuration; and inserting a binder clip into said device to retain it in said completed configuration.

15. The method of claim 13 wherein the step of providing further includes the step of:

forming said device in its completed configuration by injection molding.

* * * * *